US005910643A

United States Patent [19]

Laine et al.

[11] Patent Number: 5,910,643

[45] Date of Patent: Jun. 8, 1999

[54] SCREW-ON ELECTRICAL WIRE CONNECTOR

[76] Inventors: Peter A. Laine, 35 Oliver Dr.; Robert A. Miskell, 9 Julie La., both of Hudson, N.H. 03051

[21] Appl. No.: 08/996,729

[22] Filed: Dec. 23, 1997

Related U.S. Application Data

[60] Provisional application No. 60/038,867, Feb. 18, 1997.

[51] Int. Cl.[6] ..... H01R 4/22

[52] U.S. Cl. ..... 174/87; D13/150

[58] Field of Search ..... 174/87; 403/396, 403/400; 81/124.1, 124.2; 140/118, 149; D13/150

[56] References Cited

U.S. PATENT DOCUMENTS

| | | | |
|---|---|---|---|
| 3,139,481 | 6/1964 | Swanson | 174/87 |
| 3,156,762 | 11/1964 | Matthysse | 174/87 |
| 3,350,499 | 10/1967 | Swanson | 174/87 |
| 3,448,223 | 6/1969 | Thorsmas | 174/87 |
| 3,716,653 | 2/1973 | Willmarth | 174/87 |
| 3,769,862 | 11/1973 | Miller | 81/124.2 X |
| 3,875,324 | 4/1975 | Waddington et al. | 174/87 |
| 4,065,637 | 12/1977 | Allison . | |
| 4,227,040 | 10/1980 | Scott . | |
| 4,707,567 | 11/1987 | Blaha . | |
| 4,823,650 | 4/1989 | Tuttle | 81/124.2 |
| 4,858,312 | 8/1989 | Van Naarden . | |
| 5,256,962 | 10/1993 | Munniksma et al. . | |
| 5,260,515 | 11/1993 | Braun Jr. . | |
| 5,308,922 | 5/1994 | Wallace et al. | 174/87 |
| 5,557,069 | 9/1996 | Whitehead et al. . | |
| 5,557,070 | 9/1996 | Tamm . | |
| 5,559,307 | 9/1996 | Whitehead et al. . | |
| 5,778,896 | 7/1998 | Seals et al. | 131/181 |
| 5,784,935 | 7/1998 | Korinek | 81/467 |

*Primary Examiner*—Kristine Kincaid
*Assistant Examiner*—Chau N. Nguyen
*Attorney, Agent, or Firm*—Vernon C. Maine; Scott J. Asmus

[57] ABSTRACT

The invention is a twist-on electrical connector incorporating a shallow recess or fitment in its endcap opposite the open end of the socket, to enable application or installation onto electrical wires with a screwgun, screwdriver or similar handheld tool equipped with a corresponding male tip. The connector may incorporate a fitment snap off feature or fitment geometry failure feature to limit the torque that can be applied through the fitment and promote consistent quality of installation. The sidewalls of the connector may be smooth to inhibit installation and removal without tools. The fitment geometry may be compatible with more than one tip design.

15 Claims, 5 Drawing Sheets

SCREW-ON ELECTRICAL WIRE CONNECTOR

This application relates to and claims priority of U.S. provisional application Ser. No. 60/038867, filed Feb. 18, 1997, by the same applicants, now abandoned.

BACKGROUND OF THE INVENTION

1. Technical Field of the Invention

The present invention relates to electrical wire connectors that may be rotatingly applied with the aid of handheld tools to electrically connect, cover and bind exposed electrical wire ends; and particularly to electrical wire connectors that may be rotatingly applied with screwdriver tips.

2. Background Art

A screwdriver tip is a longitudinal projection or male structure at the end of a tool, shank, or bit, that is configured with a keyed pattern. Commonly used patterns include straight blade tips for slotted screw heads, Philips tips with their characteristic X pattern and tapered tip, hexagonal head tips, star tips, and square tips. The screwdriver tip is intended to be readily inserted into a closely conforming recess or female fitment on a subject device such as an externally threaded screw type fastener, for the immediate and temporary purpose of installing or otherwise operating or engaging the device by rotation.

The engagement of the tip with the conforming recess or fitment, with the tip being supported with proper alignment relative to the subject device, results in a non-rotational relationship between the tip and the subject device. Applying a rotating force on the tool, shank or bit, that is in excess of the resistance offered by or through the subject device, causes the subject device to be rotated, up to the structural limits of the materials and design.

It is common for externally threaded screw fasteners, such as common wood screws, to have a female structure for receiving a screwdriver tip, or for bolts and machine screws capable of accepting more torque, to have hex head male structure. It is likewise common and practical for internally threaded fasteners to be configured with an external or male type interfacing structure for use with a socket or female type tool tip such as a wrench end. The common hex nut, as is applied to the threaded shank of a bolt, comes quickly to mind as an easy example.

Electrical circuits commonly installed in residential and commercial buildings for lighting and power for plug-in appliances typically use single or multiple strand electrical wires encased in an insulating jacket and bundled two or more together inside sheathing or conduit. Romex™ or equivalent wire products are used for running circuits from main fuse panels, connecting between junction boxes, switch boxes and terminal outlet boxes of all types.

For connections in circuits carrying in the range of 30 amperes and 120 or 240 volts, incoming wire bundles are inserted into and clamped to the box, the bundle sheathing within the box is removed to separate the individual conductors, and a short section of the insulating jacket is removed from each wire, exposing a short length of each individual conductor. The conductor ends common to one circuit are joined with a twisting motion. The twisted conductor ends are then secured with electrical wire connectors; internally threaded fasteners capped at one end, made from electrically non-conducting materials.

The prior art of wire connectors used for this type of work include those based on a simple plastic socket with a knurled exterior for easy gripping and turning with the thumb and forefinger, and an internal spiral locking spring. The connector is rotationally threaded over the wire ends and tightened sufficiently finger tight to assure a reliable physical and electrical connection of the wire ends. The skirt of the insulator socket, when properly applied, extends beyond the bared ends and over the insulation. The newly joined wires are then coiled and compressed into the box for closure. Ideal WIRE NUT™ is a commonly known brand name for wire connectors of this type.

Variations of wire connectors include interior changes intended to improve the physical and electrical gripping of the wire ends, and exterior appendages and variations intended to facilitate the ergonomics and effectiveness of by-hand application. Related variants to these wire connectors include those applied by machines in manufacturing environments. A representative sampling follows.

Allison's U.S. Pat. No. 4,065,637 is an electrical connector with an external grove formed in the tube to provide a convenient means for holding the tube in an automatic assembly machine. Scott's U.S. Pat. No. 4,227,040 is a screw-on electrical connector disclosing new internal elements, but not suggesting any improvements to the exterior. Blaha's U.S. Pat. No. 4,707,567 is a screw-on electrical connector and method of making it, disclosing internal elements and methods not relating to the exterior. Van Naarden's U.S. Pat. No. 4,858,312 relates to torque control for an automatic connector assembly tool, illustrating a motor driven applicator for installing twist-on wire connectors.

Munniksma's U.S. Pat. No. 5,256,962 is a lighted wire connector. Whitehead's U.S. Pat. No. 5,557,069 is a twist-on connector with special internal and external features intended to improve by-hand application. Whitehead's U.S. Pat. No. 5,559,307 is similar to his '069, the same or a closely related design is optimized for hand application. Tamm's U.S. Pat. No. 5,557,070 is an ergonomically correct by-hand twist-on connector.

It is apparent that the art of wire connectors continues in the main to rely on the oldest and most obvious means of applying torque for installation; twist them on by hand. Attempts to provide connectors compatible with the next most obvious means, socket tipped tools, has flopped commercially due to its inconvenience to electricians to have a socket tipped power tool readily available.

Meanwhile, the construction industry has advanced to the point where commercial electricians carry and use battery powered screwdrivers, or screwguns as they may be called, on the job as a standard tool of the trade. In normal use, the screwguns are virtually always equipped with a Philips tip, the most commonly used fastener geometry in the industry for installing electrical fixtures. However, no where is it apparent in the art that the contemporary use of handheld, battery operated screwguns with the preferred screwdriver tips for installing other electrical apparatus fasteners could be easily and effectively applied to the further purpose of installing wire connectors.

SUMMARY OF THE INVENTION

The invention, in it's simplest form, is a twist-on electrical connector with a fitment incorporated into it's endcap or closed end to enable application or installation onto electrical wires with a screwgun, screwdriver or similar tool equipped with a male type screwdriver bit, preferably a Philips style bit.

It is an object of the invention to provide a twist-on wire connector that can be applied manually in the conventional manner of turning with thumb and forefinger, or by use of a screwdriver, screwgun or similar tool equipped with a screwdriver bit. To this end, a connector of the invention incorporates a shallow, formed recess or fitment in its endcap that accepts insertion of a screwdriver tip in a non-rotational manner.

It is a further object of the invention to provide a means for limiting the application of torque applied to a wire connector to a pre-calculated amount. To this end, the connector of the invention includes pre-engineered weak section between the fitment end and the main body of the connector, calculated to shear or snap off when excess torque over the amount needed to install the connector is applied. The weak section may be a narrow grove or channel circumscribing the connector just forward or distal of the fitment, the depth of which is calculated to leave sufficient material so that the endcap with the fitment recess snaps off when excess torque over the amount needed to properly install the connector is applied.

It is a yet further object to provide a wire connector which, once installed, cannot be easily removed or reused. To this end, a wire connector may be configured with a smooth walled, cylindrical exterior, and a snap-off endcap with fitment. Excess torque is applied when the connector is installed, causing the endcap to snap off, thus leaving the connector firmly attached to the wires without easy means for removal or reinstallation by hand or with tools.

Still other objects and advantages of the present invention will become readily apparent to those skilled in this art from the following detailed description, wherein we have shown and described only a preferred embodiment of the invention, simply by way of illustration of the best mode contemplated by us on carrying out our invention.

DESCRIPTION OF THE PREFERRED EMBODIMENT

Figure 1:
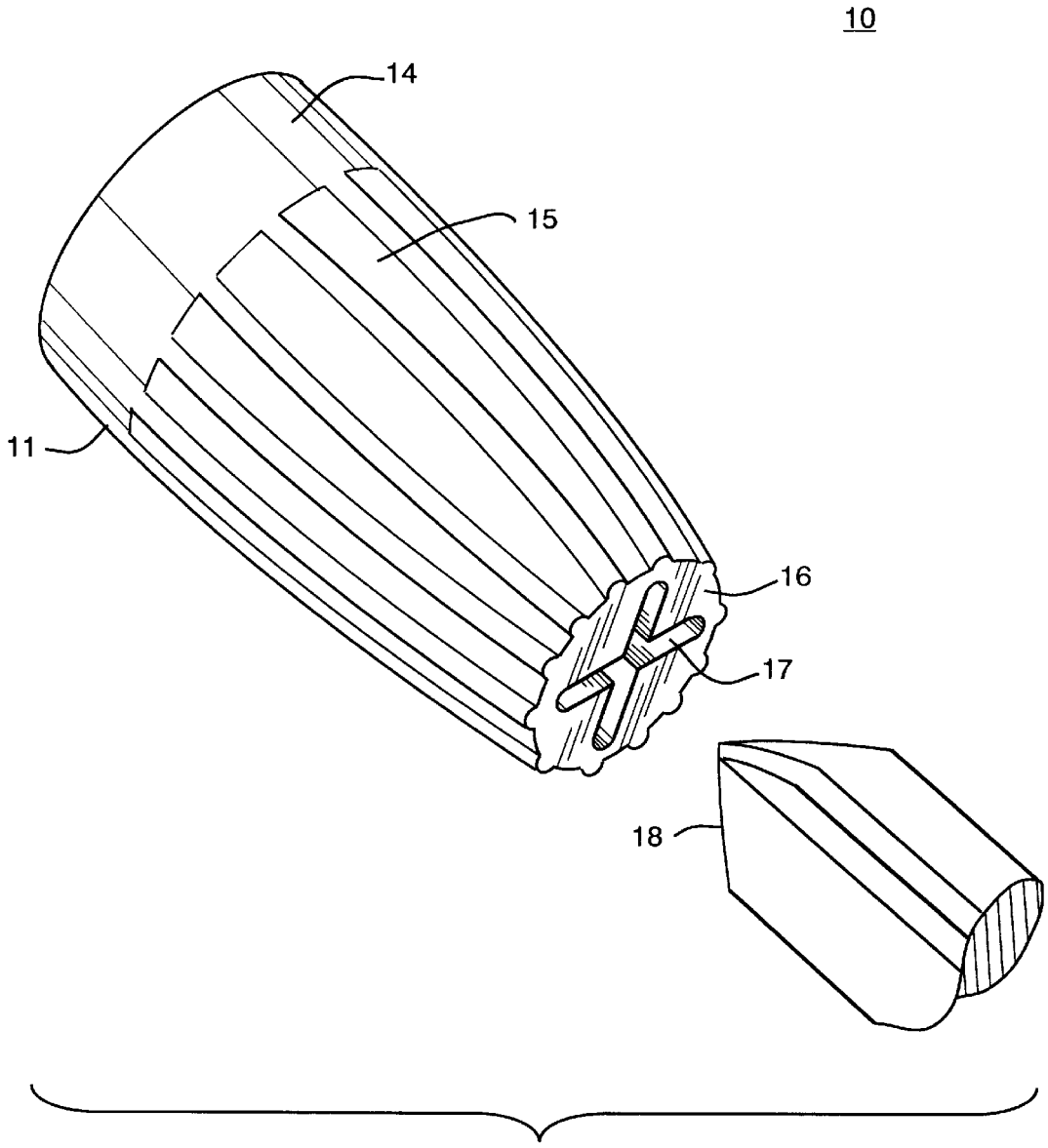
FIG. 1 is a perspective view of a wire connector of the invention slotted to receive the tip of a Phillips head screwdriver.
Figure 2:
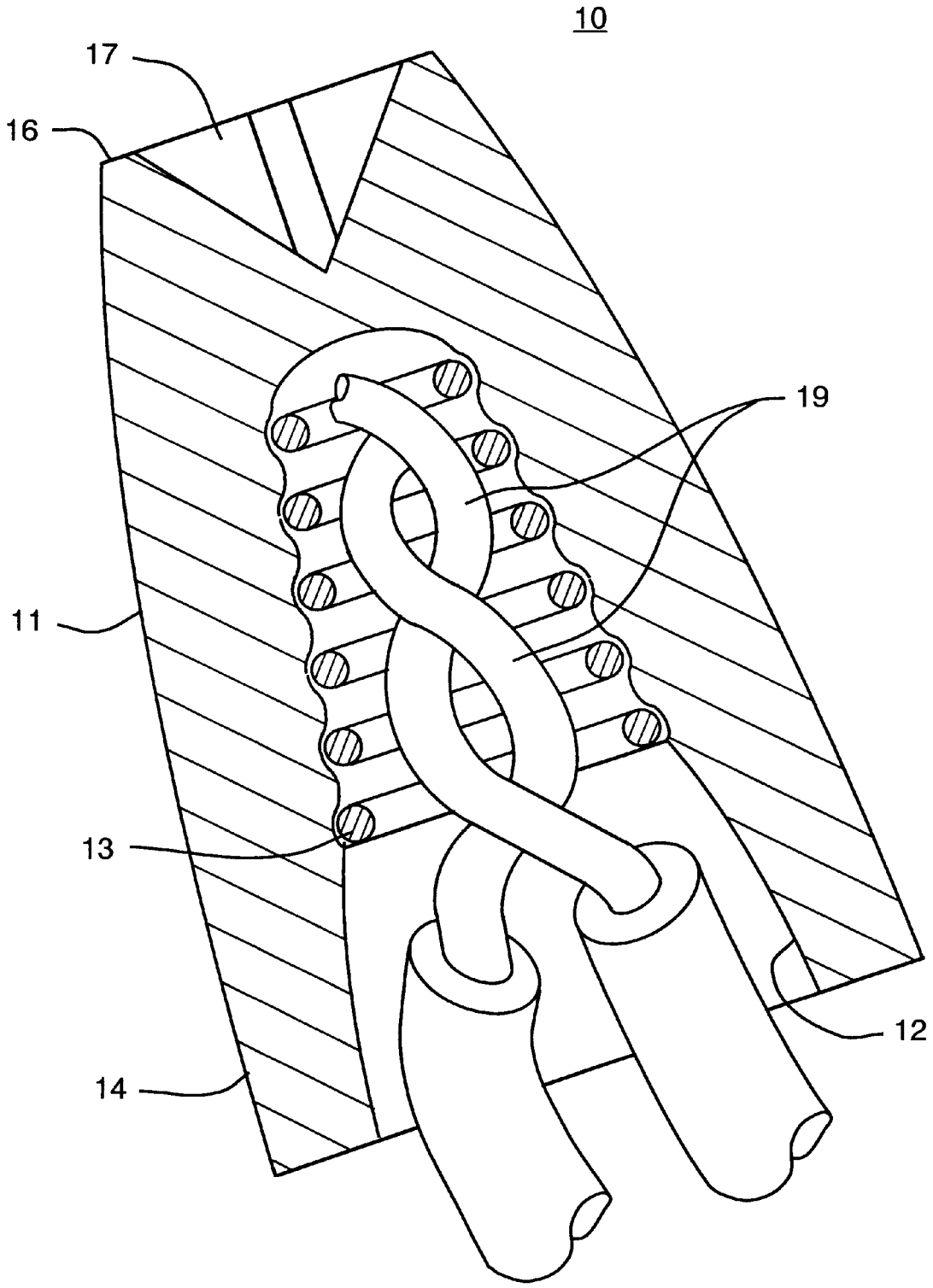
FIG. 2 is a cross section of the connector of FIG. 1, twisted onto the adjacent, uninsulated conductor ends of a pair of wires, and showing the relatively shallow slot in the end cap.

The invention admits of many variations, the preferred embodiments being examples only. Referring to FIGS. 1 and 2, electrical wire connector 10 consists of insulator shell 11, housing the usual prior art features of an interior socket 12 and spring 13 for rotationally gripping the bare conductor ends 19 of a pair of electrical wires. Shell 11 has a skirt 14, and external knurled section 15 and end cap 16. The end cap is configured with a receiving fitment 17, a shallow deformation on the external end of the cap in the form of an X or Phillips head slot that will receive tip 18 of a Phillips head screwdriver in a non-rotational manner, allowing wire connector 10 to be rotated on a set of wire ends by manipulation of the screwdriver.

It will be noted that fitment 17 is necessarily not deep, so as to not add excessive length to the overall connector as compared to prior art connectors without this fitment. Fitment 17 likewise does not intrude, interfere or otherwise impinge on the use of knurled section 15 for applying connector 10 by hand . Fitment 17 can be an integral part of the mold design of shell 11, or the result of an additional operation on shell 11, after it is created. It will be further noted that the degree of engagement or interface between the Phillips head screwdriver tip and connector 10 is not intended and cannot provide any significant lateral support to keep the connector and the screwdriver in rigid axial alignment, but rather depends on the manual dexterity of the user to keep the connector properly aligned with the wire ends, and the screwdriver aligned with the connector.

Figure 3:
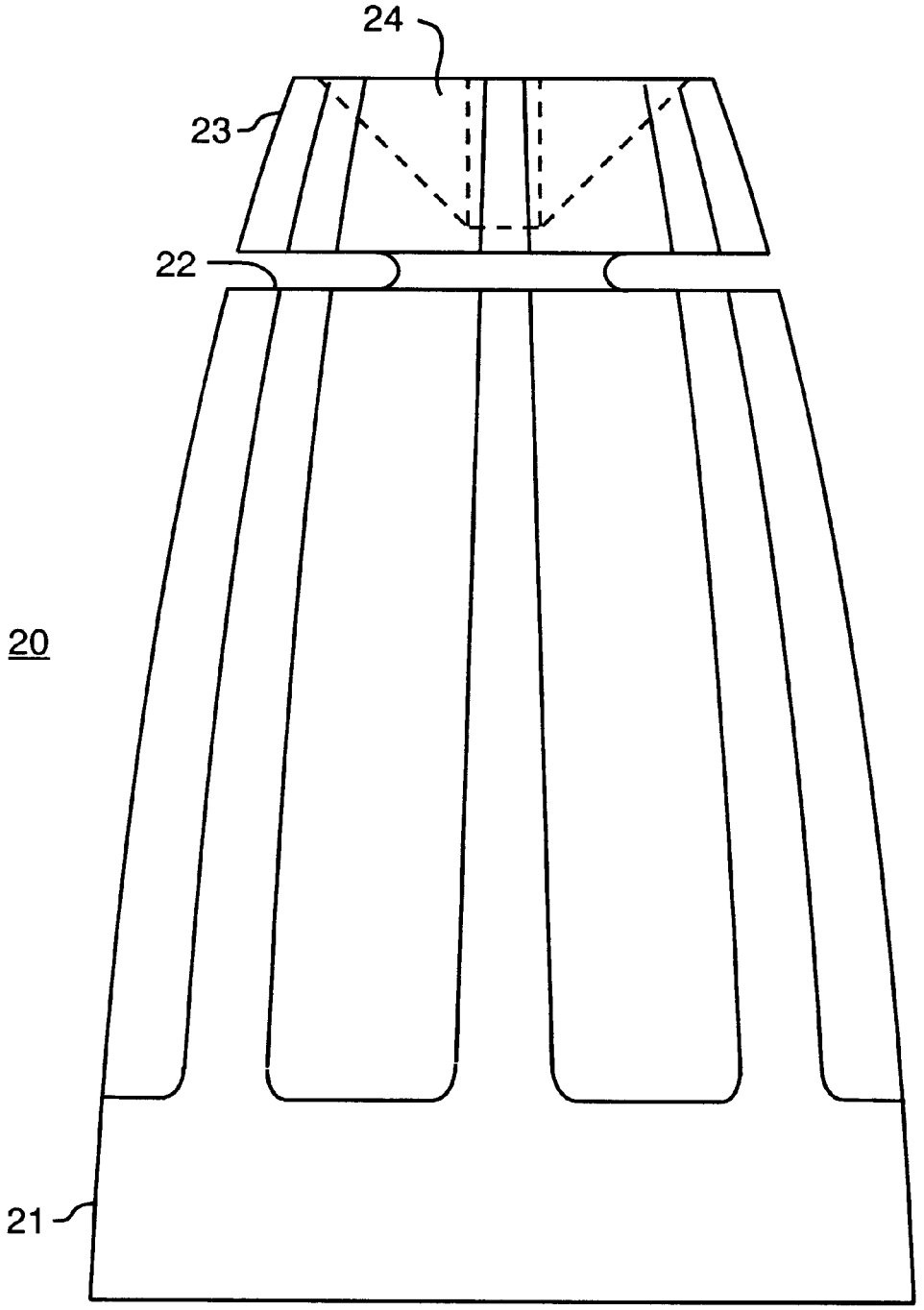
FIG. 3 is a side view of a variation on the invention, disclosing a snap-off torque limiting feature.

Referring to FIG. 3, a useful variation on the invention provides that connector 20 use a shell 21 which incorporates a narrow grove or channel 22 distally of fitment 24. This creates a reduction in cross sectional area of shell 21 at that point that is susceptible to such torque as may be applied to connector 20 with a screwdriver. The material of shell 21 and the depth of channel 22 are thus pre-calculated to allow end cap 23 with fitment 24 to twist, shear and snap off when sufficient torque to affect a proper wire connection has been exceeded, providing a uniformity of application to all such connectors. It will be noted that the width of channel 22 is insubstantial as to the length of shell 21 and does not adversely affect the application of the connector by hand.

Figure 4A:
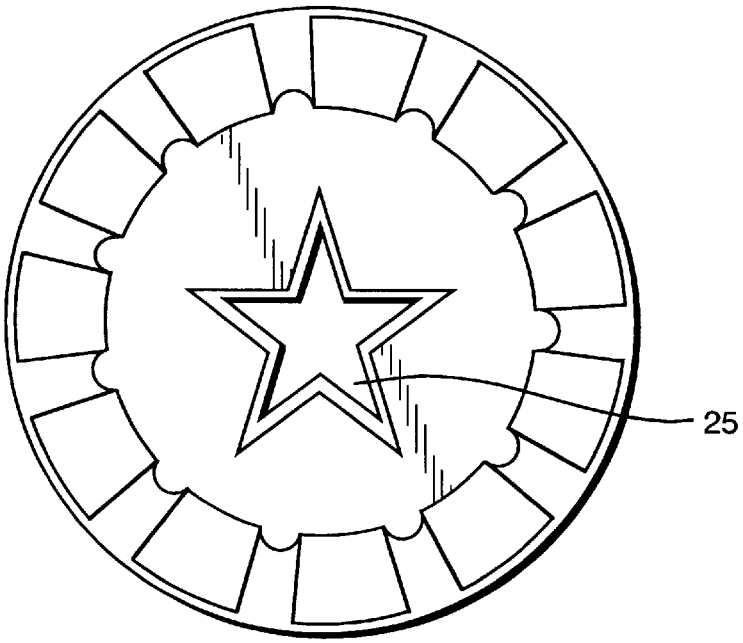
FIG. 4A configured to received a star-type hand tool, FIG. 4B configured to receive a Phillips head screwdriver, FIG. 4C configured to receive a straight blade screw driver, and FIG. 4D configured to receive a hex tip hand tool.
Figure 4B:
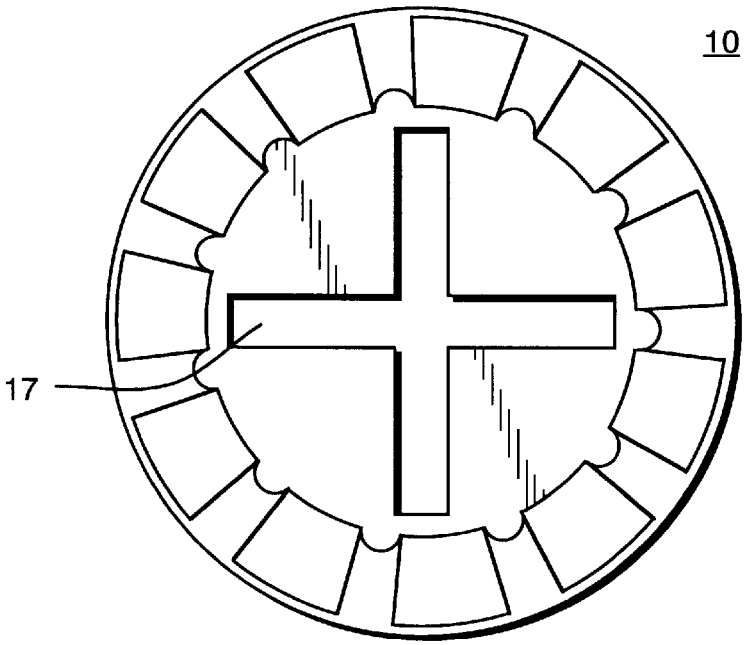
Figure 4C:
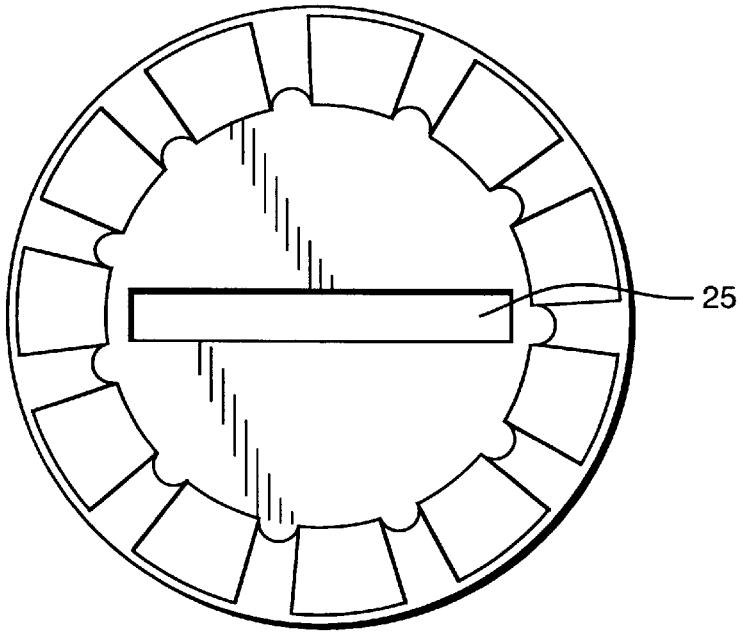
Figure 4D:
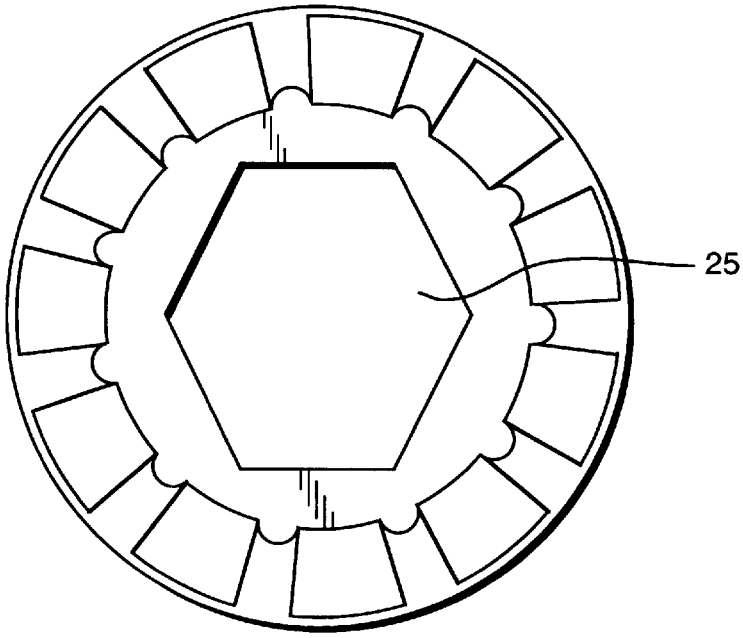

Referring to FIG. 4A, fitment 25 is shown in the form of the commonly known star bit. FIG. 4B shows the Phillips head slot of fitment 17 of connector 10. FIGS. 4C and 4D show fitment 25 configured to accept a conventional straight blade tip and a hexagonal tip, respectively. It will be readily apparent from these examples that the scope of the invention includes any shallow pattern for fitment conforming to the tip of an available handheld tool intended for rotation of fasteners and the like, where the size and shape of the pattern can be incorporated into the endcap of the connector without adding excessive length. The invention further includes connectors incorporating patterns for fitments that avoid adversely affecting the use of the external features or knurled section for applying the connector by hand.

As will be realized, the invention is capable of other and different embodiments, and its several details are capable of modifications in various obvious respects, all without departing from the invention. For example, it will be apparent from the drawings and the above description, that a variation of the connector of the invention can be formed with smooth external sidewalls, rather than a knurled section, and incorporate the snap-off feature of FIG. 3. This embodiment could only be readily applied by use of a conforming screwdriver or handheld tool. Once the torque limit is reached and the endcap snaps off, the remaining connector shell cannot be easily removed except by deformation with another tool or actual destruction. This is desirable to insure that only new connectors are applied to wire connections, and also to inhibit tampering or unauthorized modifications.

Other examples and variations include an electrical connector for connecting electric wires consisting of a hollow cylindrical structure closed at one end to form a socket with an end cap. The socket is configured so as to physically bind and electrically connect the twisted tips of the bare wires when set over them and rotated to pull them into the socket. The end cap has a receiving fitment recessed into its exterior surface opposite the opening to the socket, with the fitment being axially aligned with the socket. The fitment is configured to accept non-rotational engagement with a closely conforming screwdriver tip.

The connector can be molded or formed with a fixed geometry closely conforming to any particular desired pattern of screwdriver tips, including Phillips, star style, hex head, straight blade, and other different or novel patterns. Furthermore, the fitment geometry may combine two or more patterns, within the limitations of size, strength of materials and torque requirements, such as Philips and straight blade. This allows either tip style to be used with the connector, providing greater flexibility in the choice of tips on the jobs.

As a further variation, the fitment of the connector may be structurally separated and electrically insulated from the socket, insuring that the tip or tool does not come into contact with bare electrical wires during the installation.

Also, the cylindrical structure of the connector may have knurled ribs or other raised relief or texture on the exterior surface to improve the manual grip for handling or application by hand when necessary. Conversely, the connector may be expressly bereft of such features, to inhibit "by hand" installations and removals.

A special feature may be included for limiting the application of torque applied through the fitment to the socket, to keep the connector from being over torqued on the twisted wires. One way this can be done is by including a snap off section with a known torque limit between the fitment and the socket. Another variation of this feature is to engineer and fabricate the geometry and materials of the fitment structure so as to have a specific structural limit to applied torque. Applying excessive torque on the tip causes a deformation or failure of the fitment geometry in its proper non-rotational engagement with the tip, allowing the tip to slip in the fitment.

The objects and advantages of the invention may be further realized and attained by means of the instrumentalities and combinations particularly pointed out and claimed herein. Accordingly, the drawings and description are to be regarded as illustrative in nature, and not as restrictive.

What is claimed is:

1. A rotationally applied electrical connector for connecting electric wires, comprising a hollow cylindrical structure closed at one end to form a socket and an end cap, said socket configured with means for rotatively engaging a multiplicity of uninsulated conductor ends of said electric wires, said end cap comprising a receiving fitment recessed into its exterior surface, said fitment being axially aligned with said socket and configured to accept non-rotational engagement with a Phillips style screwdriver tip.

2. The electrical connector of claim 1, said fitment being structurally separated and electrically insulated from said socket.

3. The electrical connector of claim 1, said cylindrical structure further comprising a textured exterior surface for aiding in manual manipulation and rotation.

4. The electrical connector of claim 1, further comprising means for limiting the application of torque through said fitment to said socket.

5. The electrical connector of claim 4, said means for limiting the application of torque comprising a snap off section interspersed between said fitment and said socket, said snap off section having a known torque limit.

6. The electrical connector of claim 4, said means for limiting the application of torque comprising the fabrication of said fitment with a specific structural limit to applied torque such that excessive torque causes failure of said non-rotational engagement.

7. The electrical connector of claim 1, the exterior sidewall of said cylindrical structure having a smooth surface.

8. A rotationally applied electrical connector for connecting electric wires, comprising a hollow cylindrical structure closed at one end to form a socket and an end cap, said socket configured with means for rotatively engaging a multiplicity of uninsulated conductor ends of said electric wires, said cylindrical structure further comprising a textured exterior surface for aiding in manual manipulation and rotation, said end cap comprising a receiving fitment recessed into its exterior surface, said fitment being structurally separated and electrically insulated from said socket, said fitment being axially aligned with said socket and configured to accept non-rotational engagement with a Phillips style screwdriver tip, said connector further comprising means for limiting the application of torque through said fitment to said socket.

9. The electrical connector of claim 8, said means for limiting the application of torque comprising a snap off section interspersed between said fitment and said socket, said snap off section having a pre-determined torque limit.

10. An electrical connector for connecting electric wires, comprising a hollow cylindrical structure closed at one end to form a socket and an end cap, said socket configured with means for rotatively engaging a multiplicity of uninsulated conductor ends of said electric wires, said cylindrical structure further comprising a textured exterior surface for aiding in manual manipulation and rotation, said end cap comprising a receiving fitment recessed into its exterior surface, said fitment being structurally separated and electrically insulated from said socket, said fitment being axially aligned with said socket and configured to accept non-rotational engagement with at least one conforming tip, said connector further comprising means for limiting the application of torque through said fitment to said socket.

11. The electrical connector of claim 10, said at least one conforming tip including a Phillips style screwdriver tip.

12. The electrical connector of claim 10, said at least one conforming tip including a star style screwdriver tip.

13. The electrical connector of claim 10, said at least one conforming tip including a hex head key tip.

14. The electrical connector of claim 10, said at least one conforming tip including a straight blade screwdriver tip.

15. The electrical connector of claim 10, the exterior sidewall of said cylindrical structure having a smooth surface.

* * * * *